US006739992B2

(12) United States Patent
Kümmerle

(10) Patent No.: US 6,739,992 B2
(45) Date of Patent: May 25, 2004

(54) ARROWHEAD AND METHOD OF ATTACHING SAME TO AN ARROW SHAFT

(75) Inventor: Berthold Kümmerle, Rheinfelden (DE)

(73) Assignee: Gebr. Kümmerle GmbH, Rheinfelden (DE)

( * ) Notice: Subject to any disclaimer, the term of this patent is extended or adjusted under 35 U.S.C. 154(b) by 0 days.

(21) Appl. No.: 10/438,667

(22) Filed: May 15, 2003

(65) Prior Publication Data

US 2003/0216198 A1 Nov. 20, 2003

(51) Int. Cl.[7] ..... F42B 6/08
(52) U.S. Cl. ..... 473/582
(58) Field of Search ..... 473/578, 582, 473/586

(56) References Cited

U.S. PATENT DOCUMENTS 2,265,564 A * 12/1941 Klopsteg
2,599,626 A * 6/1952 Gottschalk et al.
2,790,473 A * 4/1957 Roper
3,756,601 A * 9/1973 Frey et al.
3,868,114 A * 2/1975 Groner
4,305,588 A * 12/1981 Dodge
4,874,180 A * 10/1989 Fingerson et al.
5,234,220 A * 8/1993 Schellhammer et al.
5,611,542 A * 3/1997 Saunders
5,921,875 A * 7/1999 Bickel

* cited by examiner

*Primary Examiner*—John A. Ricci
(74) *Attorney, Agent, or Firm*—Sidley Austin Brown & Wood, LLP

(57) ABSTRACT

An arrowhead for attachment onto a cylindrical wooden arrow body of an arrow has an impact tip and a body-receiving area having following one another in a flight direction: a centering section, internal thread, and sheathing section.

13 Claims, 2 Drawing Sheets

ARROWHEAD AND METHOD OF ATTACHING SAME TO AN ARROW SHAFT

BACKGROUND OF THE INVENTION

1. Field of the Invention

The invention relates to an arrowhead for attachment to a cylindrical shaft of an arrow and having an impact tip and a shaft-receiving area, and to a method of attaching an arrowhead to the cylindrical shaft of an arrow.

2. Description of the Prior Art

In archery, among other things, arrows are used that are generally made as a cylindrical wooden rod to an end of which an arrowhead in the form of a slip-on or screw-on fitting is attached. As a rule, the arrowhead is made of a metal such as steel, brass, aluminum, or stainless steel.

It is known from the state of the art for the arrowhead fitting to have a conical bore into which one shaft end of the wooden rod is inserted. Here, it is always necessary for the cylindrical shaft end of the arrow body to undergo prior working so that it will have a corresponding conical shape. As a rule, a sharpening device is used that is specially designed for such a purpose.

Such a connecting technique in which the conical shaft end of the wooden rod has to be practically pressed on and attached by an adhesive has a drawback that consists in that the connection already comes loose after the arrow has been: used just a few times, since the connection cannot withstand strong tensile forces, especially when the arrow is being pulled out of a target. Moreover, the use of glue causes a deviation in the coaxiality that exists between the arrowhead fitting and the wooden arrow body and that is necessary for satisfactory accuracy of the flight path.

With this object in mind, it is known from the state of the art, for example, from German utility model DE 297 11 254 U1, to provide the conical bore with an additional, self-cutting internal thread into which the corresponding conical shaft end of the wooden rod can be screwed.

However, this solution still has a disadvantage which consists in that the proper centering of the cone being used depends to a great extent on the exact fit between the shaft diameter of the arrow body and a standard sharpener used for this purpose, which can certainly have an effect on the aiming accuracy. Moreover, it is amply known from actual practice that, with this connection solution as well, a bit of glue has to be added in order to obtain a satisfactory final attachment of the arrowhead. So far, it has not been possible to prevent the connection from coming loose as a result of impact when the arrow has struck a hard object several times.

When the arrowhead fitting, which is stuck in the target and which has a conical right-handed thread according to the above-mentioned state of the art, is turned a few times to the left in order to remove it, then the effect already occurs that the thread flanks of this right-handed thread can no longer grasp any material on the wooden rod and consequently the arrowhead comes off the shaft.

Moreover, another known drawback is that, through the prior working of one shaft end of the arrow body in order to give it a conical shape, this shaft end is considerably weakened due to the reduction of its diameter, whereby, in view of the enormous impact forces that occur when the arrow strikes the target, the shaft end can very easily break and splinter.

Moreover, the known arrows used for archery entail a familiar problem that appears especially when such arrows are pulled out. When it comes to targets, as a rule, the arrowhead penetrates about 15 to 20 cm into the material. The arrows of this type are designed in such a way that the arrowhead and the shaft have the same diameter, with the consequence that both components of the archery arrow, which are made of different materials, are gripped non-positively over this entire penetration depth. Consequently, such an arrow can hardly be pulled out without using turning motions. As a result of the right-handed thread that is provided, if the arrow is pulled out by inadvertently turning the arrow body to the left, the arrowhead fitting becomes detached from the shaft of the arrow body and remains stuck in the material of the target.

In the light of the drawbacks described above, the object of the present invention is to simplify the attachment used for an arrowhead, whereby the latter should be readily replaceable and the connection that exists between the arrowhead and the arrow body should have a longer service life.

SUMMARY OF THE INVENTION

This and other objects of the present invention are achieved by providing an arrowhead the receiving area of which has a centering section followed by an internal thread and a sheathing section; and by providing a method of attaching the arrowhead to the shaft in which the shaft is screwed into the internal thread.

According to the invention an arrowhead geometry that is newly designed in many areas is provided whose essential characteristics lie primarily in the area of the shaft receptacle.

The arrowhead fitting or the arrowhead according to the invention is characterized in that a receiving, area of the arrowhead that lies opposite from the impact tip that penetrates the target is divided into three sections or areas that differ in terms of their function but that interact as a whole to ensure a permanently impact-resistant and pull-proof connection that is also centered and detachable. These sections are:

- a centering section that is arranged immediately behind the impact tip, for purposes of centering the arrow body when it is assembled or screwed in, in order to provide sufficient coaxiality for an accurate flight path;
- an internal thread that adjoins the centering section, seen opposite from the direction of flight, that serves to create a detachable connection; and
- adjoining said internal thread, a sheathing section that surrounds the shaft of the arrow body to such an extent that it prevents splintering as a result of the impact against the target.

In one embodiment of the invention the internal thread is a self-cutting thread, preferably a wedge-edge thread, whose wedge flanks are oriented in the direction opposite to the direction of flight of the arrow.

The wedge-edge thread is such that ring-shaped impact or striking surfaces are formed that are perpendicular to the axis of the arrow body and that can effectively absorb the impact forces when the arrow penetrates the target.

It is clear that, through the one-sided flattening of the thread shape of the internal thread in the form of a wedge-edge thread, especially as a result of the wedge flanks being oriented towards the inside, when the arrow body is twisted in, on one hand, a force-locking connection is obtained and, on the other hand, thread furrows are formed on the shaft end of the arrow body.

Thanks to the design according to the invention of the arrowhead, a permanently impact-resistant and pull-proof connection is ensured between the arrowhead and the arrow body, while at the same time, this connection can be detached again at any time in a simple manner.

Since the internal thread as well as the entire receiving area of the arrowhead are essentially cylindrical in shape, a conventional cylindrical shaft end of an arrow body can be screwed in. There is no need for a corresponding prior working of the shaft end to give it a conical shape.

In another embodiment of the invention, the receiving area has at least one, preferably two, conical sections with differing tapering slants near the end of the receiving area, that is to say, before the internal thread in the direction of the arrowhead. Such a section facilitates the centering of the arrow body when it is being screwed into the arrowhead. When the arrowhead is being screwed in, due to the pressing forces that occur during the self-centering procedure, the material of the shaft end, which is generally made of wood, is pressed together in the area of these centering conical sections. Furthermore, this pressed material also serves to absorb some of the impact forces in the same manner as the conical surfaces of these sections themselves.

At the base of the receiving area, that is to say, at the end of the centering section, there is another ring-shaped impact or striking surface that likewise serves to absorb the impact forces.

Moreover, the base of the receiving area has a blind hole whose, diameter and depth can be selected differently in order to tare the weight of the arrowhead for purposes of optimizing the flight properties.

According to the invention, the opening of the receiving area, at the end of the arrowhead opposite from the impact tip, has a chamfer that facilitates the insertion of the shaft end of the arrow body.

In another embodiment, on the outside of the sheathing section that preferably has the same length as the internal thread, the arrowhead is tapered so as to create a rounded shoulder and it is oriented in the direction opposite from the direction of flight. Since the arrowhead has a larger diameter than the shaft of the arrow, the material of the target widens when the arrowhead penetrates it. As a result of the rounded shoulder that is provided here at the end of the arrowhead, the arrow and thus the connection made up of the arrow, and the arrowhead does not encounter any resistance when it is pulled out, so that this serves to prevent a detachment of the arrowhead from the arrow body.

The arrowhead according to the invention having the features described above provides for a method for attaching the arrowhead onto the cylindrical shaft of an arrow that is made, for example, of wood, in that the shaft is screwed into the internal thread of the receiving area of the arrowhead, causing thread furrows to form on the shaft, and the end of the shaft is compressed in the centering section, thus causing a press fit.

Here, the same that applies to a screw also applies to the thread according to the invention, which encircles a wooden rod. The thread pitch and the thread height of the internal thread have to be selected at such a size that as much wood as possible is grasped between them.

Since the connection according to the invention can be effected without glue, it is also more user-friendly. Through the precise centering, the flight properties of an arrow using one of these arrowheads are less affected. Since, in comparison to the versions from the state of the art, this connection cannot readily become detached, such arrows have a longer service life and entail less costs since arrowheads that would otherwise be left sticking in the target do not have to be later removed and consequently cannot damage the target or subsequent arrows that would strike the target.

The arrowhead according to the invention can be made of all kinds of metal materials, preferably of simple and thus inexpensive steel. However, versions made of polyamide or injection-molded and curable materials are also conceivable.

BRIEF DESCRIPTION OF THE DRAWINGS

Below, the invention will be illustrated in greater depth on the basis of two embodiments, with reference to the accompanying drawings. The drawings show.

DETAILED DESCRIPTION OF THE PREFERRED EMBODIMENTS

Figure 1:
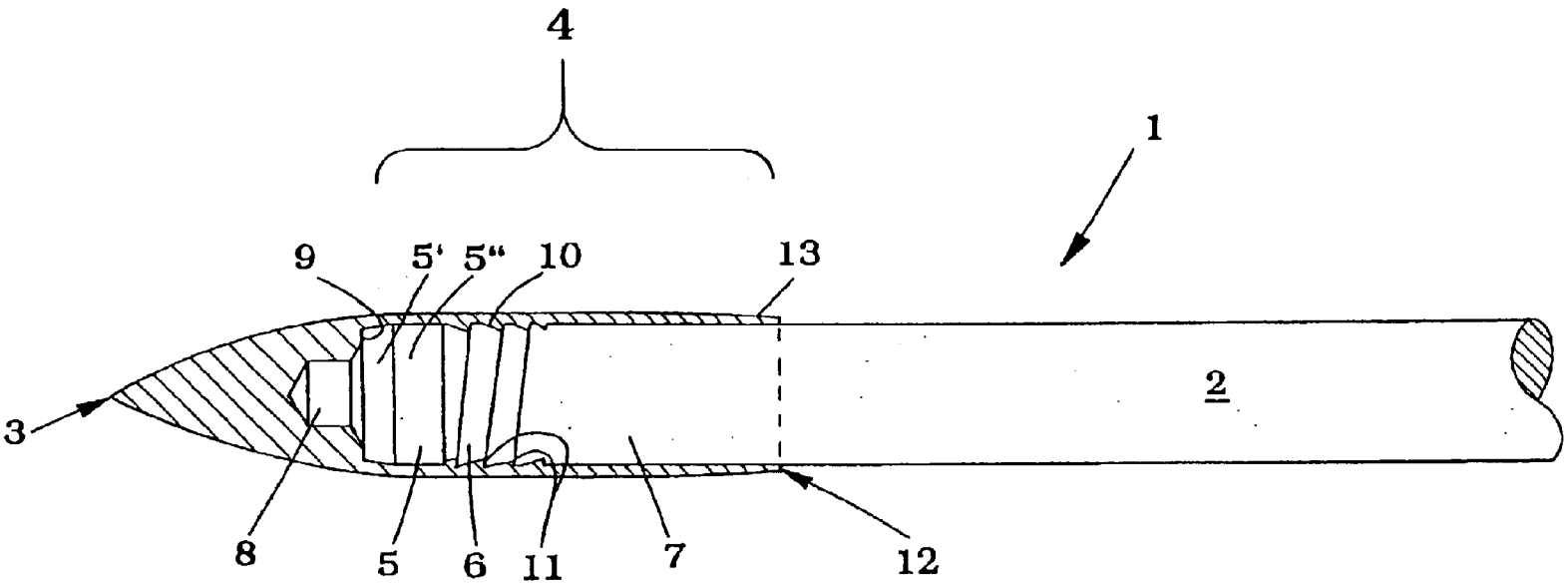
FIG. 1—a side, partially cross-sectional view of a first embodiment of the arrowhead according to the invention.
Figure 2:
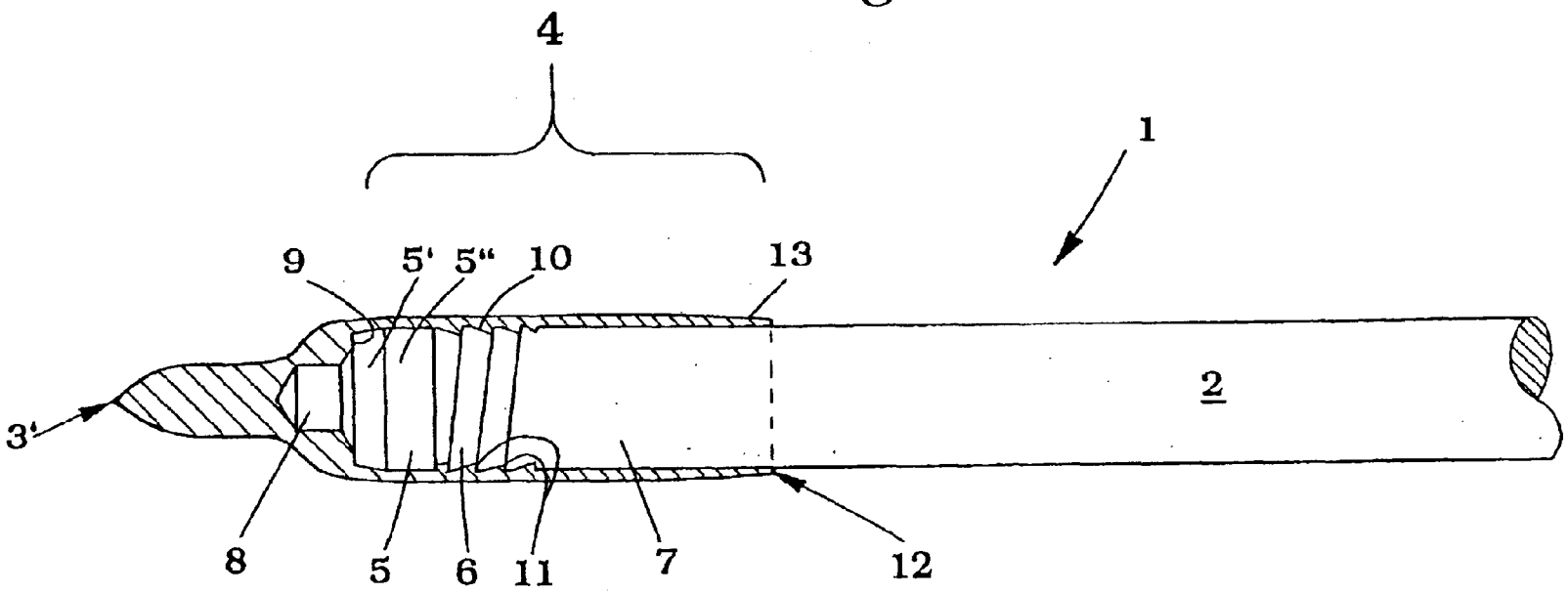
FIG. 2—a side, partially cross-sectional view of a second embodiment of the arrowhead according to the invention with a different impact tip geometry.

The arrowheads shown in FIGS. 1 and 2 embody the same features according to the invention that are marked correspondingly with the same reference numerals.

FIGS. 1 and 2 each schematically show an arrowhead 1 into which a shaft 2 of an arrow is screwed. The arrowhead 1 has an appropriately shaped impact tip 3 and 3', respectively.

The arrowhead 1 is placed onto an arrow shaft made of wood and the shaft end of the arrow shaft is inserted or screwed into a receiving area 4 of the arrowhead 1.

The receiving area 4 is divided into three sections, namely, a centering section 5, an internal thread 6, and a sheathing section 7.

The centering section 5, in turn, is divided into two truncated sections 5 and 5' that each have a different tapering in such a way that the centering section 5 is: altogether tapered towards the impact tip 3, 3'. When the shaft 2 of the arrow is screwed in, the material at the end of the shaft, typically wood, is compressed. At the same time, a precise centering is achieved during the insertion.

At the base of the receiving area 4 or of the centering section 5, there is a blind hole 8. Depending on its diameter, a ring-shaped impact surface 9 is then formed at the base of the receiving area 4 and said impact surface 9 is able to absorb impact forces that are transmitted to the arrowhead 1.

The internal thread 6, in this embodiment is configured as a wedge-edge thread (or so-called bone thread), whereby the wedge flanks 10 of the internal thread 6 are slanted in the direction opposite to the direction of flight.

In this manner, several ring-shaped impact or striking surfaces 11 are formed that serve to further absorb the impact forces.

In the area of the opening of the receiving area 4, there is provided a chamfer 12 that facilitates the insertion of the shaft end of the arrow 2.

The sheathing section 7, by surrounding the shaft end over a certain length, serves to absorb the forces that are caused by the impact against the target and that can cause splintering in the area of the shaft end made, for example, of wood. Here, it is advantageous if the sheathing section 7 is preferably longer than the centering section 5 and the internal thread 6 combined.

On the outside, the sheathing section 7 of the arrowhead 1 has a rounded shoulder 13 that is opposite from the impact tip 3, 3' and that is tapered opposite from the direction of flight. This outside tapering serves to make it easier to pull the arrow 2 and the arrowhead 1 out of the material of the target, a procedure which is additionally facilitated by the fact that the arrowhead 1 has a larger diameter than the shaft 2 of the arrow.

Naturally, according to the invention, other types of threads that meet the requirement for a permanently impact-resistant and pull-proof connection between the arrowhead 1 and the arrow 2 while, at the same time, allowing a repeated non-destructive detachment of this connection are also possible instead of a key thread.

Accordingly, though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof and the present invention includes all of variations and/or alternative embodiments within the spirit and scope of the present invention as defined by the appended claims.

What is claimed is:

1. An arrowhead for attachment to the cylindrical wooden shaft of an arrow, comprising an impact tip; and a sleeve-shaped receiving area for the shaft, wherein the receiving area (4) has following one another in a flight direction: a centering section, an internal thread (6), and a sheathing section.

2. The arrowhead according to claim 1, wherein the internal thread is a self-cutting thread.

3. The arrowhead according to claim 1, wherein the internal thread is a wedge-edge thread.

4. The arrowhead according to claim 3, wherein flanks (10) of the wedge-edge thread are slanted in a direction opposite to the impact tip with formation of ring-shaped impact surfaces (11).

5. The arrowhead according to claim 1, wherein the centering section is conically tapered in a direction of the impact tip.

6. The arrowhead according to claim 5, wherein the centering section is divided into at least two areas, whereby a conical tapering of the areas increases in the direction of the impact tip.

7. The arrowhead according to claim 5, wherein a contact surface is provided at a base of the receiving area of the centering section.

8. The arrowhead according to claim 1, wherein a blind hole, whose depth is selected so as to tare a weight of the arrowhead, is provided at a base of the receiving area.

9. The arrowhead according to claim 1, wherein the sheathing section has a length at least equal to a length of the internal thread.

10. The arrowhead according to claim 1, wherein the sheathing section has an insertion chamfer for the shaft.

11. The arrowhead according to claim 1, wherein the outside of the sheathing section has a rounded shoulder that is tapered in a direction opposite from the impact tip.

12. The arrowhead according to claim 1, wherein a diameter of the arrowhead (1) is larger than a diameter of the shaft (2).

13. A method of attaching an arrowhead having an impact tip, and a sleeve-shaped receiving area having following one another in a flight direction: a centering section, internal thread, and sheathing section, onto the cylindrical wooden shaft of an arrow, comprising the step of screwing the shaft into the internal thread of the receiving area of the arrowhead (1), whereby thread furrows are formed on the shaft, causing an end of the shaft to be compressed in the centering section of the receiving section (4), creating a press fit.

* * * * *